US008647452B2

(12) United States Patent
Bearden et al.

(10) Patent No.: US 8,647,452 B2
(45) Date of Patent: Feb. 11, 2014

(54) METHOD FOR MAKING ARTIFICIAL TURF

(76) Inventors: John H. Bearden, Woodstock, GA (US); Randal A. Enterkin, Woodstock, GA (US)

( * ) Notice: Subject to any disclaimer, the term of this patent is extended or adjusted under 35 U.S.C. 154(b) by 763 days.

(21) Appl. No.: 12/614,287

(22) Filed: Nov. 6, 2009

(65) Prior Publication Data

US 2010/0129570 A1 May 27, 2010

Related U.S. Application Data

(60) Provisional application No. 61/117,616, filed on Nov. 25, 2008.

(51) Int. Cl.

| | |
|---|---|
| ***B32B 37/00*** | (2006.01) |
| ***B32B 3/10*** | (2006.01) |
| ***E01C 13/08*** | (2006.01) |

(52) U.S. Cl.
USPC ..... 156/72; 428/95; 428/97

(58) Field of Classification Search
USPC ..... 156/72, 61; 428/95, 97, 17
See application file for complete search history.

(56) References Cited

U.S. PATENT DOCUMENTS

| | | | | |
|---|---|---|---|---|
| 3,856,596 | A * | 12/1974 | Shorrock | 156/72 |
| 3,922,454 | A * | 11/1975 | Roecker | 428/95 |
| 4,007,307 | A | 2/1977 | Friedrich | |
| 4,389,434 | A | 6/1983 | Polman | |
| 4,705,706 | A | 11/1987 | Avery | |
| 5,567,257 | A * | 10/1996 | Higgins et al. | 156/72 |
| 6,264,775 | B1 * | 7/2001 | Holeschovsky et al. | 156/72 |
| 6,316,088 | B1 * | 11/2001 | Ogawa et al. | 428/297.4 |
| 6,328,833 | B1 * | 12/2001 | Holeschovsky et al. | 156/72 |
| 6,338,885 | B1 | 1/2002 | Prevost | |
| 6,726,976 | B2 | 4/2004 | Dimitri | |
| 7,323,056 | B2 | 1/2008 | Horie et al. | |
| 7,364,634 | B1 | 4/2008 | Irwin, Sr. | |
| 7,563,498 | B2 * | 7/2009 | Shimizu et al. | 428/95 |
| 2006/0013989 | A1 | 1/2006 | Stull et al. | |
| 2006/0076100 | A1 * | 4/2006 | Doney | 156/72 |
| 2007/0292655 | A1 * | 12/2007 | Albin | 428/92 |
| 2008/0020174 | A1 | 1/2008 | Stull et al. | |

FOREIGN PATENT DOCUMENTS

| | | | |
|---|---|---|---|
| EP | 5050 | A * | 10/1979 |
| EP | 1752506 | A1 * | 2/2007 |
| JP | 2000014522 | A * | 1/2000 |
| JP | 2002172967 | A * | 6/2002 |
| WO | WO 2009056284 | A1 * | 5/2009 |

* cited by examiner

*Primary Examiner* — Cheryl Juska
(74) *Attorney, Agent, or Firm* — Invention Protection Associates, LLC

(57) ABSTRACT

An artificial athletic turf includes a backing having a top face and a bottom face, yarn tufted through the backing such that cut pile extends from the top face and backloops of yarn are closely adjacent the bottom face and a discontinuous coat is disposed over the backloops and bottom face in order to bind the yarn to the backing. The coating material is sprayed onto the bottom face of the tufted backing at an inclination angle of less than 45 degrees to the plane of the backing and under conditions which cause sprayed material to bind the backloops to the backing, but not deposit along narrow areas of the backing between rows of backloops, thus, allowing the turf to remain porous in spots.

9 Claims, 3 Drawing Sheets

METHOD FOR MAKING ARTIFICIAL TURF

BACKGROUND

The present invention generally relates to methods for producing synthetic grass, and it is specifically directed to an improved method of applying adhesive to the stitches, or backloops, of the yarn that is tufted into a backing material—a method which represents a more efficient process for producing an artificial athletic turf that possesses desirable qualities relative to its water permeability and dimensional stability.

Artificial turf has long been used as a playing surface for sports that are traditionally played on grass fields, such as football, baseball and soccer to name a few. In many parts of the country which experience exceedingly cold, rainy or dry weather during the times of year such sports are customarily played in organized leagues, an artificial turf playing surface can be virtually essential to playing outdoors. For example, an artificial turf may be preferable to natural grass for an outdoor football field in the Great Lakes region because of the tendency of a natural surface to harden and become more difficult to maintain as a consequence of the cold weather that the region experiences during the autumn football season. At the same time, in the Pacific Northwest, a water permeable synthetic surface may be preferable because of the water puddling and overall deterioration that a natural surface would exhibit due to excessive rainfall in that geographical region. Conversely, because the arid conditions of the desert Southwest require that considerable irrigation efforts be made in order to maintain natural grass fields, synthetic turf is often preferred as a football playing surface in that part of the country as well. Furthermore, an artificial turf playing surface makes it possible for sports traditionally performed on grass to be played inside climate controlled indoor facilities, as artificial turf does not require the exposure to sunlight needed to sustain natural grass.

Artificial athletic turf is generally comprised of at least one textile fabric backing through which filament yarn, which resembles grass is inserted via a tufting process, as well as a resilient base mat which provides underlying support to the tufted backing A tufting machine of some construct is used to insert loops of selected yarn into a backing sheet, and the yarn is then bonded thereto by applying a coating material to one side of the backing. Typically, the tufting machine features a series of yarn-carrying, reciprocating needles which punch downward through the backing so that the delivered yarn may be caught by looper devices to form elongate yarn loops along the top side of the backing (i.e., the side of the backing which faces upward upon the turf's installation as a playing surface) as the needles returns upward and out of the backing After the needles reciprocate, the backing or needles shift so that the needles may repeat their stroke and form backloops along the bottom of the backing In this tufting process, yarn is selectively protruded through the backing to a depth that corresponds with the desired length of the simulated grass blades being formed, and the ends of the top side loops are severed to render cut piles. After tufting, usually, coating material is applied to the backloops in order to bond the tufted yarn to the backing with lock strength (i.e., the force required to pull a strand yarn out of the backing) sufficient to withstand the stresses of the athletic performance to take place on the turf. Alternatively, the backloops of thermoplastic yarns may be heated in order that they fuse to the backing.

For field installation, the tuft-locked backing is usually placed atop a resilient base mat which helps to help cushion athletes' joints and give the synthetic turf surface a more natural feel. Additionally, a granular mix of small particles (typically, rubber and sand particles) may be poured atop the tufted backing to infill the space between synthetic grass blades. Aside from further improving resiliency, this infill material also imposes a protective barrier between the athletes' cleats and the backing fabric.

Again, it is generally necessary to coat the bottom of the tufted backing in order to prevent yarn from dislodging during athletic use, but doing so can pose challenges that the prior art has evolved in effort to overcome. Traditionally, a continuous solid film or viscous liquid layer of thermoplastic or thermosetting coating material has been applied to the bottom side of a backing sheet, and then heat is applied thereto in order to either solidify the liquid or to liquefy the solid film so that it envelops the yarn backloops, seals the yarn insertion holes and then forms a solid layer upon being cured by cooling. In either case, the cured coating layer locks the tufts to the backing. Furthermore, since the spacing of their individual woven fibers may cause some woven fabrics to exhibit poor dimensional stability under the stress of athletic activity, putting the backing fibers in a common matrix with a coating layer should improve the stableness of the turf and render it less prone to stretch or otherwise deform during use.

Applying a continuous coating film to an athletic turf backing can present potential drawbacks, though. First of all, while it is generally desired that a tufted pile structure made for home or office carpet use be water sealed, the opposite is true for that made for athletic use. As mentioned earlier, it is essential that water and other fluids be able to drain through an athletic turf. Therefore, assuming that the continuous coating layer adhered to an athletic turf backing is water impermeable, as tends to be the case when coating material is deposited onto the backing in a liquid or solid phase, the coated backing must undergo further processing to give it porosity. Specifically, drainage holes must be introduced into it. For artificial turfs that are infilled, as most contemporary sports turfs are, these drainage holes can present challenges. To wit, although the infill layer is a porous element, its individual particles can flow into and clog drainage holes within the backing, and can further matriculate down into pores residing within a base layer of material underlying the backing Consequently, in addition to diminishing the porosity of the turf, enough infill particles may eventually sift through the backing's drainage holes to necessitate a replenishing of infill material in order to prevent the playing condition of the turf from appreciably degrading. Finally, punching these needed drainage holes into a fabric backing may, to some degree, effectively offset the increase in dimensional stability that was achieved by coating it. So, over time, the cumulative effects of climate exposure and stress imposed by athletic use may cause the drainage to stretch and exacerbate the problems related to their presence. This simply accelerates the aforementioned maintenance demands, and ultimately, it shortens the useful life of the turf.

Another negative implication of continuously coating the backing (as opposed to somehow selectively, discontinuously coating it) is the volume of coating material consumed in doing so. Not only is the material cost obviously greater, a continuous coating layer substantially increases the weight of the turf product and, thus, makes it more expensive to transport. Of course, when fuel prices skyrocket as they did in 2008, this becomes a significant cost component in the turf product distribution and sale chain.

A well-known alternative method of achieving tuft lock in an artificial athletic turf applications involves thermally bonding to the backing a tufted, grass-simulating thermoplastic yarn in lieu of applying coating material. For example, U.S. Pat. No. 4,705,706 to Avery discloses a process of tufting yarn fabricated of thermoplastic material, such as polyethylene, into a backing fabricated of a material, such as nylon, which has a higher fusion point than the yarn. After the tufting process, the bottom side of the backing is heated to a temperature not quite high enough to degrade the backing, but sufficient to melt the yarn backloops so that their inner surfaces can adhere to the adjacent backing surface, obviating the further need to apply a coating in order to achieve satisfactory tuft lock. However, because the pile yarn atop the tufted backing must be shielded from the heat being applied to the yarn backloops disposed below the backing layer, as a practical matter, it may be necessary to tuft the yarn into multiple layers of backing fabric that can, together, form an adequate heat sink. Therefore, the total cost of producing the turf product may be increased by the inclusion of a secondary backing sheet(s) that might not be needed if the yarn was bonded to the primary backing by way a separate coating material.

To overcome these disadvantages, methods for discretely applying coating onto the linear the rows of yarn backloops disposed along the bottom surface of a backing, while leaving space between tuft rows uncoated, have been developed in the prior art as well. For example, U.S. Pat. No. 6,726,976 to Dimitri discloses a method of producing a tufted pile which involves applying linear strips of binding material to a backing and, subsequently, tufting yarn through both the backing and binding material so that areas of the backing surface between the tufted yarn rows remain uncoated. Alternatively, Dimitri teaches the pre-tufting application of a continuous sheet of highly shrinkable thermoplastic binder material to a backing that, upon being heated post-tufting, will shrink so that binder material concentrates around the yarn backloops and leaves uncoated spaces along the backing surface. Similarly, U.S. Pat. No. 6,338,885 to Prévost discloses the proposition of depositing strips of coating material only onto rows of yarn backloops so that interstitial spaces between rows remain uncoated. Alternatively, Prévost teaches the placement of a comb-like device, which has fingers that fit within the channels between backstitch rows, over the bottom of a backing prior to applying coating material and then removing the device and the coating that is deposited onto it thereafter. The comb-like device shields the backing fabric between yarn rows from the applied coating so that it retains its permeability characteristics, and, depending on the backing fiber, the need to puncture drainage holes may be averted. Prévost also discloses the proposition of using a series of nozzles to apply thin lines of coating exclusively onto the yarn backstitch rows.

There are a couple of obvious benefits of depositing coating material only onto the yarn rows in order to achieve tuft lock, as such a practice minimizes production costs by reducing the amount of coating material consumed therein, and it eliminates the need to mechanically perforate the coated backing for drainage purposes—thereby avoids the above mentioned perils of doing so. However, in order to be practiced in a remotely efficient, automated manner, previously disclosed methods for coating a backing sheet in such discontinuous fashion generally required the use of a coating machine possessing a series of several nozzles or solid strip applicators which are appropriately spaced to enable coating material to be deposited precisely onto the numerous longitudinal rows of yarn (or row paths yet to be tufted) along a backing sheet that is advanced below them. In fact, if a particular such machine features a series of fewer coating applicators than are the total number of yarn rows to be coated, then the backing necessarily must be run through the machine multiple times so that its applicators can be laterally shifted into positions for coating individual rows not coating during a previous run(s). Further complicating the issue are matters of tufted yarn rows being spaced differently, from one article of artificial turf to another, or of them being non-linear, as may be dictated by the particular athletic activities to be performed upon them or by graphic design considerations. Consequently, the coating applicators along a machine for applying a discontinuous coat must be spaced and/or shifted in accordance with the precise layout of yarn rows along a particular backing piece or pieces to be seamed together. Similarly, multiple different coat shielding devices may need to be substituted, from coating task to task, to accommodate the need for variations in finger spacing. This can demand tedious work in adjusting coating delivery and shielding mechanisms between coating tasks. Moreover, the proposition of applying coating material in alignment with non-linear tuft patterns can be even more daunting.

Therefore, it can be appreciated that there exists a need for an improved method for making artificial turf—a method in which the backloops of yarn tufted into the turf backing are coated in a manner that achieves tuft lock sufficient to render the turf adequate for athletic use, and a method that can be repeated with equal effectiveness on virtually all turf backings which bear linear rows of tufted yarn, regardless of the relative spacing of their respective yarn rows. The present method for producing artificial athletic turf substantially fulfills this need.

SUMMARY OF THE INVENTION

It is an object of the present invention to produce an artificial athletic turf in which execution of the step of coating a tufted backing to achieve tuft lock may be precisely replicated on virtually every article of backing that is linearly tufted, irrespective of the actual spacing of their respective parallel rows of tufts. Consequently, the present invention eliminates the need to adjust coating machinery or modify coating technique in accordance with variations in tuft placement specifications of different articles of linearly tufted backing.

It is another object of the invention to create a synthetic turf product for use as an outdoor athletic turf without implementing any of the normal practices for achieving both tuft lock and sufficient drainage properties. Specifically, by employing a tuft locking technique that represents an unconventional step in conventional methods for producing artificial athletic turf, the present turf production method obviates the need to, for example, heat yarn tufts in order to tackify and thermoplastically bond them to the bottom face of a primary backing Consequently, the material cost associated with including a secondary backing that functions as a heat sink and protects the yarn pile which extends from the top face of the backing may be avoided. As another example, the present method renders unnecessary a precision driven coating dispenser that is capable of discretely placing thin lines of liquefied coating material precisely onto the spaced tuft rows formed within a particular backing. Alternatively, the instant method eliminates the additional step of perforating a continuously coated backing in order to recreate porosity after completing the steps of applying coating material to the backing and allowing the material to cure.

In one aspect of the invention, a new turf product comprises three main components: (1) a water permeable backing member, (2) yarn that is tufted into the backing in separate rows and (3) coating material that is discontinuously disposed on the bottom face of the backing More specifically, coating material is applied to the bottom face of the backing such that it blankets the top and a side (right or left) of the tuft backloops within each row, but generally does not cover the opposing side of the backloops. The backing may be of any type commonly used in athletic turf applications. The yarn should simulate natural grass, and it is tufted into the backing so as to form a pile along the top face of the backing and rows of yarn backloops along the bottom face. The coating material has the dual purposes of: (a) bonding together individual fibers that exist within the backloop portion of each tuft; and (b) bonding the tufts to the backing so that the tufts are not dislodged under the strains of athletic use. It is believed that a wide variety of sprayable adhesive materials could be used as coatings in the present turf construction. However, it is preferable that the chosen coating material be deposited onto the backing in discrete particles by way of a high pressure spray and that the coating composition and the spray environment conditions are such that those particles rapidly solidify upon their deposition.

In another aspect of the invention, coating particles are sprayed at the backing such that their trajectory, immediately prior to contacting the backing (or previously landed coating particles), is along an inclination angle of less than 45 degrees to the plane of the backing and is 90 degrees relative to the axes of the parallel tuft rows. This inclination angle enables the yarn backloops along the bottom face of the backing, simply by virtue of their positioning, to block airborne coating particles from landing along narrow spots of interstitial space between rows of backloops. In addition, the coating composition is selected and the spray environment controlled such that multiple factors, which may include spray pressure, spray flight distance, ambient temperature and reactivity of the coating composition, cooperate to ensure that sprayed coating particles begin congealing in flight or immediately upon landing onto the backing, yarn backloops or previously landed coating particles. Resulting changes in phase and surface tension of sprayed coating particles, therefore, occurs rapidly enough to prevent extensive puddle formation or flow of coating material onto those narrow areas of the backing surface that sprayed particles were shielded, by the backloops, from landing upon. This phenomenon may also allow side portions of the fiber openings created by yarn protrusion through the backing to function as drainage apertures without appreciably sacrificing tuft lock.

DETAILED DESCRIPTION OF THE PREFERRED EMBODIMENTS

Figure 4:
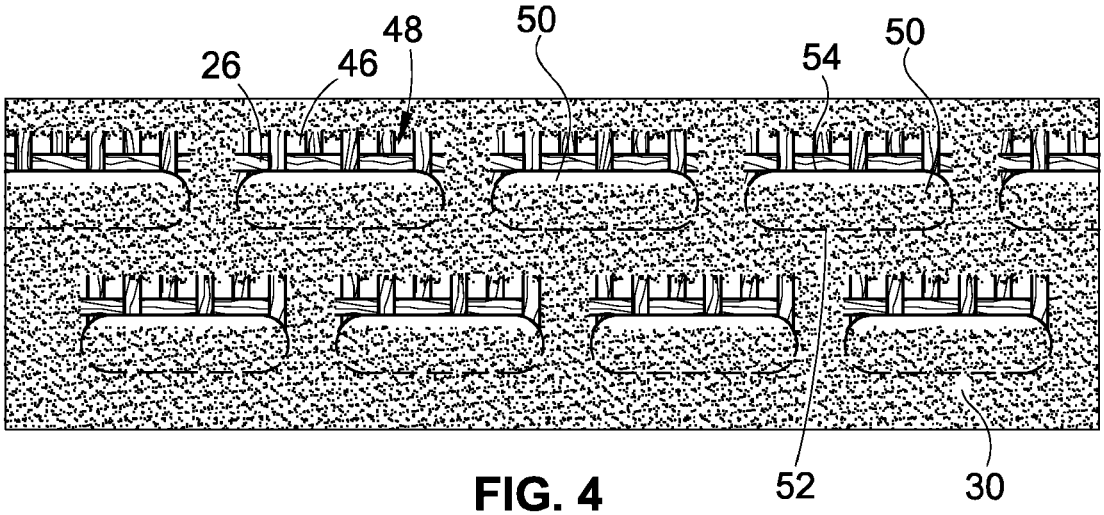
FIG. 4 is an exploded bottom perspective view of a small section of tufted and coated backing, the view showing uncoated areas along the backing.
Figure 5:
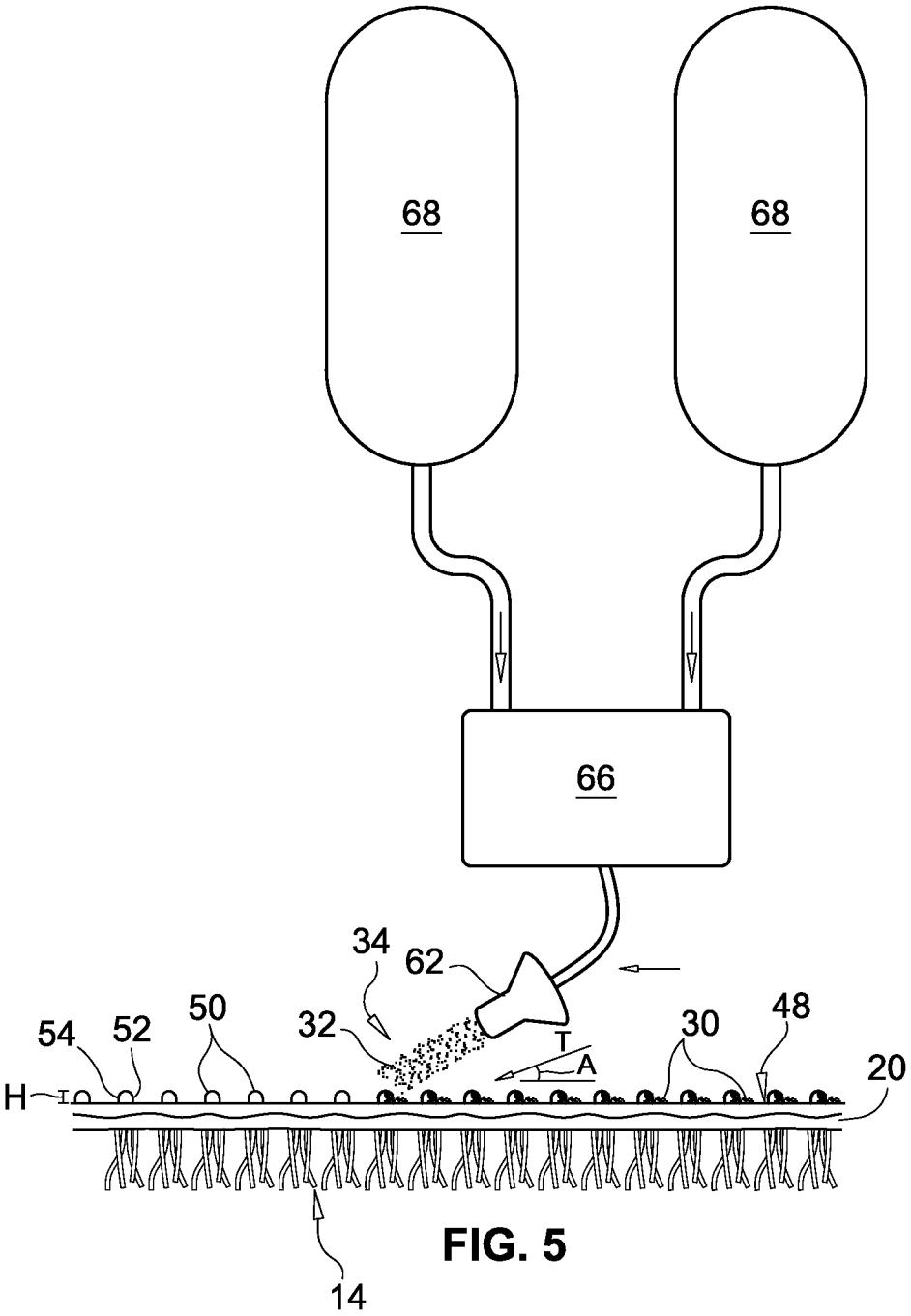
FIG. 5 is a partial diagrammatic view of a coating formulation and delivery system, the view showing coating particles being sprayed toward the backing along a trajectory angle to the backing plane.

It should be understood that the present disclosure has particular applicability to the making of artificial turf that is intended for use as a sports playing surface, but can be applied to the manufacture of synthetic grass generally. This disclosure, as illustrated in the accompanying Figure drawings, relates to an artificial athletic turf comprising a backing 20 to which at least one yarn is mechanically adhered, first, via a tufting process and then via a spray coating process. Due to the particular way in which a discontinuous layer 30 of coating material is formed along its backing element 20 as shown in FIGS. 4 & 5, the turf remains adequately water permeable without having to be perforated after being coated.

Figure 1:
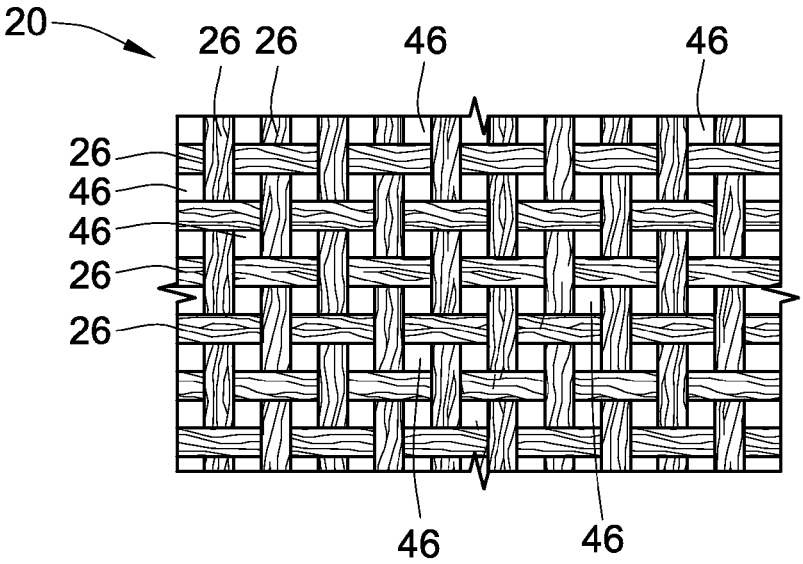
FIG. 1 is an exploded plan view of a small section of woven backing fabric.

The backing 20 may be constructed of polypropylene fabric or any other fabric commonly used for athletic turf, and it should be woven (or perforated, in the case of a nonwoven fabric) so that, even prior to being tufted and coated, it exhibits the porosity characteristics required of an installation-ready outdoor athletic turf—most notably a water drain rate of at least 40 inches per hour. However, it is preferred that the untufted, uncoated backing 20 has a significantly greater drain rate due to the existence of fabric pores 46 throughout it, as can be seen in the section of backing fabric 20 shown in FIG. 1. As will be discussed, the present method includes a coating step, depicted in FIG. 5, which is designed to ensure that uncoated spots 48 remain throughout the backing fabric 20, as can be best seen in the exploded view of FIG. 4, so that fluids may seep through fabric pores 46 existent within the exposed areas 48 of the backing 20. The natural grass-simulating yarn may be fabricated of, for example, slit-film or monofilament polyethylene or polypropylene fibers that are twisted and bundled into strands. It is anticipated that a variety of sprayable materials, such as polyurethane, polyurea, a polyurethane/polyurea hybrid or even a hot melt adhesive, conceivably can be used to bind the yarn to the backing 20 within the concept of the present invention.

Figure 2:
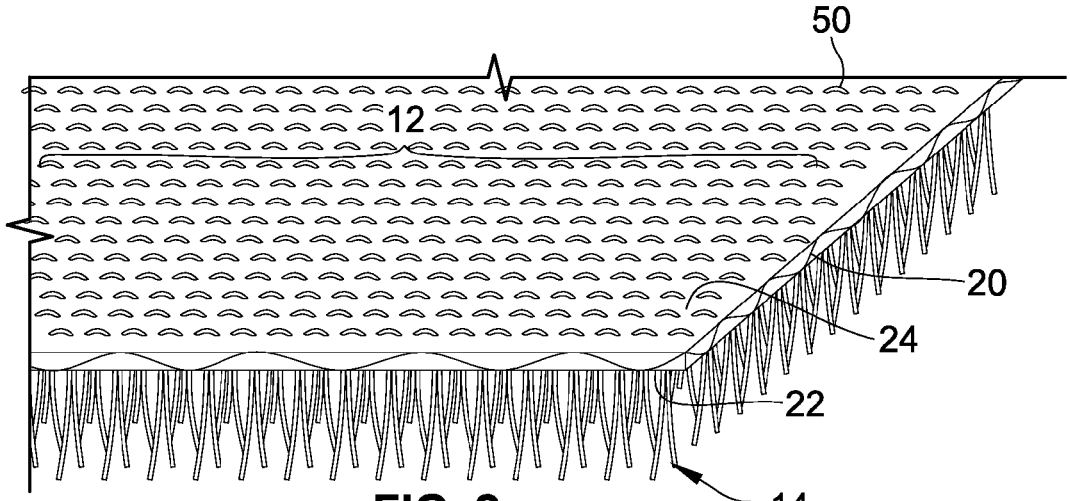
FIG. 2 is a bottom perspective view of a section of tufted backing that is uncoated, the view showing cut pile yarn extending from the backing's top face and rows of yarn backloops along its bottom face.
Figure 3:
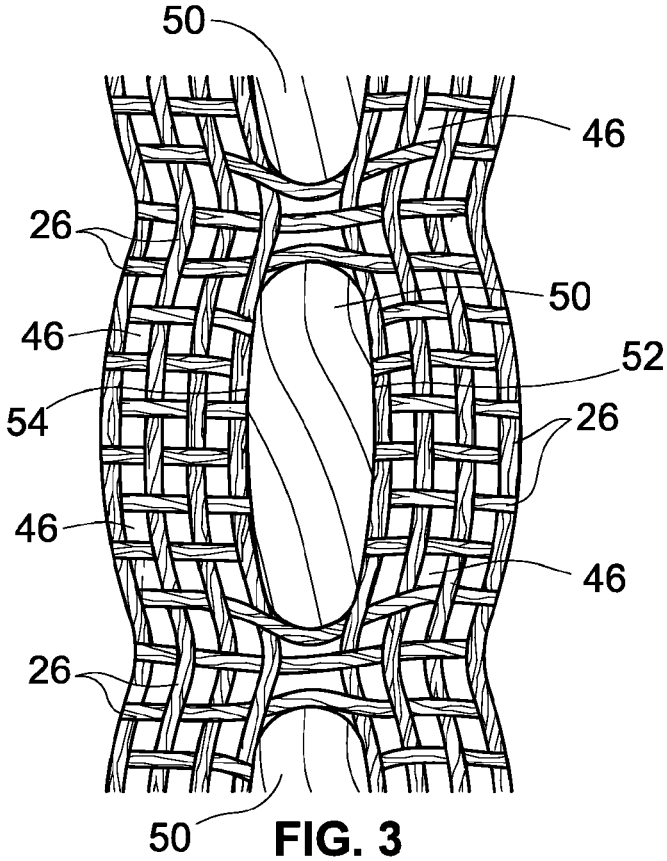
FIG. 3 is an exploded bottom plan view showing a yarn backloop.

The yarn may be inserted into the backing 20 via any of a variety of conventional tufting processes. For example, the backing 20 may be intermittently conveyed underneath a series of vertically reciprocating, yarn-carrying needles (not shown) that are aligned transverse to the direction of conveyance. Alternatively, the backing 20 may be statically held while being operated upon by the advancing tufting head of a computer-operated, gantry-type tufting apparatus such as that described by the present inventor in U.S. Published Application No. 2008/0134949 published Jun. 12, 2008 and incorporated herein by reference. In either case, the relative positions of the backing 20 and needles shift between successive downward plunges of the needles through the backing 20 so as to create yarn backloops 50 that closely overlie the backing's bottom face 24. Parallel rows 12 of these backloops 50 are illustrated in FIG. 2. Simultaneously, with the aid of catch and cutting mechanisms (not shown), the reciprocating needles form elongate yarn loops along the top face 22 of the backing 20, which are then severed to form a cut pile 14 as is also shown in FIG. 2.

Generally, the spacing of parallel, tufted yarn rows 12 depends upon the anticipated use for the turf. For example, tuft rows 12 tend to be spaced further apart in football turfs, as football turfs are typically covered with an infill material mixture (not shown), such as a blend of sand and cryogenically ground rubber, which provides greater cushioning and abrasion resistance for athletes performing on them. Wider tuft spacing accommodates the infill mixture and helps to minimize the risk of athletes' cleats getting wedged and snagged between tufts of yarn—a phenomenon that often causes serious leg injury. On the other hand, yarn rows 12 may be tufted more narrowly in synthetic turf made for activities in which cleats are typically not used and for which a less forgiving playing surface is desired.

In order to bind tufted yarn to the backing 20 so that tufts are not dislodged from the turf during its use, an adhesive coating layer 30 is applied to the bottom face 24 of the backing 20. The present invention requires that particles 32 of coating material be deposited onto the backing face 24 via a high pressure spray 34. The invention further requires that the trajectory "T" of the spray shower 34 be: (1) at an inclination angle "A" of less than 45 degrees, and preferably within a range of 10 to 30 degrees, to the plane of the backing 20; and (2) perpendicular to the axes of the parallel tuft rows 12. This spray orientation, illustrated in FIG. 5, will cause coating material to deposit disproportionately more along the proximate sides 52 of backloops 50 than on their distal sides 54, as shown in FIG. 4. For purposes of this discussion, the proximate side 52 of a backloop 50 shall be considered its side that faces the spray emitter 62 when the backloop 50 is within the path of spray 34. More importantly, the positioning of backloops 50 relative to the spray path causes the backloops 50 to block spray particles 32 from depositing on small spots 48 of backing surface 24 that are immediately adjacent the distal sides 54 of the backloops 50. These uncoated areas 48 provide porosity to the finished turf. Of course, the rough dimensions of such spots 48 will depend upon both the spray trajectory angle A and height "H" of the backloops 50. Typically, the backloop height H dimension is essentially the diameter of a twisted yarn bundle.

In addition to rendering a discontinuous coat 30 over the backing 20, the angled orientation of the spray trajectory T enhances penetration of coating material into the fiber bundled backloops 50 which, in turn, locks their yarn filaments together. This inhibits the unraveling of individual tufts. It also puts each yarn filament within a backloop 50 in direct adhesion with backing fibers 26, as coating material 30 is accumulated against and adhered to the proximate side 52 of the entire backloop 50 as well as to the backing fibers 26—effectively increasing the tuft bond strength of the turf. To those ends, it is desirable to produce an artificial turf that exhibits a water drain rate of at least 5 inches per minute and tuft bond strength of at least 12 pounds according to ANSI/ASTM D1335-67.

A polyurethane composition is used as coating material in a preferred embodiment of the present turf construction, although, as previously mentioned, other rapidly curing compositions may be used instead. As partially schematically shown in FIG. 5, reaction monomers are separately held in fluid reservoirs 68 before being pumped into a mixing head 66 within which they are blended to react and form the polyurethane coating. While in a liquid state, the coating then advances to a spray head 62 that emits a high velocity shower 34 of coating droplets 32 onto the backing face 24 as the spray head 62 traverses over the backing 20. The spray head 62, in fact, may comprise one or more nozzles that are moveably mounted along a computer-operated, gantry-type coating apparatus (not shown) configured very similarly to the tufting machine referenced above and previously described by the present inventor in U.S. Published Patent App. No. 20080134949, except that, most notably, (1) a spray head 62 replaces the tufting head of said machine and (2) the orientation of the spray head 62 is such that it emits material particles along a short flight path that forms a less than 45-degree angle A with the plane of the backing 20. However, alternative means for controlling the spray head 62, including manual control, may be employed so long as they allow for careful control of the parameters of spray trajectory, spray flight distance and relative movement of the spray head 62 and backing 20.

Finally, in addition to preventing the formed coating layer 30 from continuously covering the backing face 24, a number of spray and environmental parameters must be precisely set, in consideration of the chemical reaction of the particular coating composition selected for use, to ensure that landed composition particles 32 solidify too quickly to reconstitute liquid masses that can flow along the backing 20 and concentrate in fabric pores 46 within the narrow areas 48 that were shielded from spray 34 by the backloops 50. In fact, the coating particles 32 should begin to cure immediately upon exiting the spray head 62 and become too viscous to flow along the fibrous backing 20 by the time they contact it. The present inventor has observed that, in addition to maintaining a spray inclination angle A of 10 to 30 degrees with the plane of the backing 20, coating objectives are best met by maintaining the following combination of spray parameters: (a) a spray head pressure within a range of 1,800 to 2,000 psi; (b) a spray distance within a range of 40 to 60 inches; (c) the coating material at a temperature of at least 130 degrees Fahrenheit within the mixing head 66; and (d) an ambient temperature within a range of 68 to 77 degrees Fahrenheit.

It is further preferred that a suction device (not shown) be placed underneath the backing 20 (facing the backing's top face 22) so that spray particles 32 neither escape into the ambient air nor accumulate on any other equipment used (e.g., hood enclosure, spray head, etc.).

It is understood that substitutions and equivalents for various elements set forth above may be obvious to those skilled in the art and may not represent a departure from the spirit of the invention. Therefore, the full scope and definition of the present invention is to be set forth by the claims that follow.

What is claimed is:

1. A method of making an artificial turf, the method comprising:

selecting a porous backing having a top face and an opposing bottom face;

selecting a yarn to tuft into the backing;

selecting a coating material bond the yarn to the backing;

tufting the yarn into the backing to form grass blade-simulating yarn piles projecting from the top face and parallel rows of yarn backloops along the bottom face, wherein the backloops have proximate and distal sides; and spraying a droplet shower of coating material over the bottom face, wherein the axis of spray is at an inclination angle of less than 45 degrees to the plane of the backing, wherein sprayed coating material droplets discretely deposit against the backing and proximate sides of backloops, but are generally shielded from depositing against their distal sides and over small areas of backing adjacent the distal sides.

2. The method of claim 1, wherein viscosity of the discretely deposited coating material droplets cause them to resist flowing and puddling along the backing.

3. The method of claim 1, wherein the spray axis is normal to the backloop row axes.

4. The method of claim 1, wheren the backing is moved relative to a spray mechanism, or vice versa, during spray coating.

5. The method of claim 1, wherein spray flight distance is up to 60 inches.

6. The method of claim 1, wherein spray pressure is 1,800 to 2,000 psi.

7. The method of claim 1, wherein the coating material comprises at least one of the following: polyurethane, polyurea, a polyurethane/polyurea hybrid or a hot melt adhesive.

8. The method of claim 7, wherein the temperature of the coating material is at least 130 degrees Fahrenheit just prior to expelling from a spray mechanism, and the ambient air is approximately room temperature.

9. The method of claim 1, wherein the axis of spray is at an inclination angle within a range of 10 to 30 degrees to the plane of the backing.

* * * * *